US011199382B1

(12) United States Patent
Bride et al.

(10) Patent No.: US 11,199,382 B1
(45) Date of Patent: Dec. 14, 2021

(54) MODULAR AND SCALABLE MINE ROLLER

(71) Applicant: United States of America as represented by the Secretary of the Navy, Arlington, VA (US)

(72) Inventors: Dustin Bride, Panama City Beach, FL (US); Patrick Delay, Panama City Beach, FL (US); Jeremy Croom, Panama City Beach, FL (US); Bobbi Wood, Panama City Beach, FL (US); Daniel Coats, Panama, FL (US)

(73) Assignee: United States of America as represented by the Secretary of the Navy, Washington, DC (US)

( * ) Notice: Subject to any disclaimer, the term of this patent is extended or adjusted under 35 U.S.C. 154(b) by 20 days.

(21) Appl. No.: 16/887,292

(22) Filed: May 29, 2020

(51) Int. Cl.
*F41H 11/30* (2011.01)

(52) U.S. Cl.
CPC ..... *F41H 11/30* (2013.01)

(58) Field of Classification Search
CPC ..... F41H 11/30; F41H 11/16; F41H 11/13; F41H 11/12
USPC ..... 89/1.13
See application file for complete search history.

(56) References Cited

U.S. PATENT DOCUMENTS 1,190,257 A * 7/1916 Henderson ..... F41H 11/30 404/126
5,313,868 A * 5/1994 Wolf ..... F41H 11/30 102/402
5,685,554 A * 11/1997 Poxleitner ..... B60D 1/167 280/491.2
5,712,441 A * 1/1998 Grunewald ..... F41H 11/16 86/50
6,915,728 B2 * 7/2005 Renwick ..... F41H 11/30 102/402
8,397,612 B2 * 3/2013 Koplin ..... A01B 29/04 89/1.13
8,490,531 B2 * 7/2013 Simula ..... F41H 11/30 89/1.13

(Continued)

FOREIGN PATENT DOCUMENTS

EP 2133652 A2 * 12/2009 ..... F41H 11/30
FR 2939504 A1 * 6/2010 ..... F41H 11/16

(Continued)

OTHER PUBLICATIONS

Businesswire, "Oshkosh Defense Demonstrates Autonomous Route Clearance Mission Capability at Eurosatory 2014", Jun. 15, 2014, Businesswire.com, All. <https://www.businesswire.com/news/home/20140615005039/en/Oshkosh-Defense-Demonstrates-Autonomous-Route-Clearance-Mission-Capability-at-Eurosatory-2014>. (Year: 2014).*

(Continued)

*Primary Examiner* — Jonathan C Weber
(74) *Attorney, Agent, or Firm* — James T. Shepherd

(57) ABSTRACT

A mine roller includes a bracket having a first end and a second end. The first end is adapted to be coupled to a vehicle. A rigid table has a center section and modular sections with the center section being coupled to the second end of the bracket for rotation about the second end in a first plane. The modular sections are coupled to the center section for rotation therewith. Roller banks are coupled to two of the modular sections for rotation relative thereto in a second plane that is perpendicular to the first plane.

15 Claims, 5 Drawing Sheets

(56) References Cited

U.S. PATENT DOCUMENTS

| | | | | |
|---|---|---|---|---|
| 8,522,661 | B2 * | 9/2013 | Hembise | F41H 11/30 89/1.13 |
| 9,303,957 | B2 * | 4/2016 | Cronk | F41H 11/30 |
| 9,557,146 | B2 * | 1/2017 | Bradley | F41H 11/24 |
| 11,060,826 | B1 * | 7/2021 | Croom | F41H 11/30 |
| 2008/0236376 | A1 * | 10/2008 | Reeves | F41H 11/28 89/1.13 |
| 2011/0180283 | A1 * | 7/2011 | Koplin | F41H 11/30 172/547 |
| 2011/0232468 | A1 * | 9/2011 | Hembise | F41H 11/16 89/1.13 |
| 2011/0296976 | A1 * | 12/2011 | Simula | F41H 11/30 89/1.13 |
| 2013/0327203 | A1 * | 12/2013 | Cronk | F41H 11/30 89/1.13 |
| 2015/0362295 | A1 * | 12/2015 | Bradley | F41H 11/24 89/1.13 |
| 2018/0080746 | A1 * | 3/2018 | Cronk | F41H 7/02 |

FOREIGN PATENT DOCUMENTS

| | | | | |
|---|---|---|---|---|
| GB | 2461155 | A * | 12/2009 | F41H 11/30 |
| WO | WO-2009038762 | A1 * | 3/2009 | F41H 11/30 |

OTHER PUBLICATIONS

4×4magazin, "Oshkosh Defense UGV M ATV Mineroller", Jun. 16, 2014, YouTube, Entire Video, <https://www.youtube.com/watch?v=dm6m-NriiTI>. (Year: 2014).*

Humanistic Robotics, "Route Clearance Roller—Advanced", May 2014, Humanistic Robotics, Entire Article, <http://humanisticrobotics.com/route-clearance-roller-advanced/>. (Year: 2014).*

Humanistic Robotics, "Mine & IED Roller Solutions: Route Clearance, Anti-Tank, Dismounted, Area Clearance", May 2014, Humanistic Robotics, <http://humanisticrobotics.com/wp-content/uploads/2014/05/HRI-Roller-Brochure-Combined.pdf>. (Year: 2014).*

* cited by examiner

MODULAR AND SCALABLE MINE ROLLER

ORIGIN OF THE INVENTION

The invention described herein may be manufactured and used by or for the Government of the United States of America for Governmental purposes without payment of any royalties.

FIELD OF THE INVENTION

The invention relates generally to mine rollers, and more particularly to a mine roller whose width can be adjusted for purposes of transportation and application.

BACKGROUND OF THE INVENTION

Mine rollers are used to trigger "pressure plate improvised explosive devices" (PP-IEDs). In general, PP-IEDs consist of a pressure-induced switch, an explosive charge, and a pair of conductive paths to form an electrical circuit between the switch and charge. Downward pressure closes the switch and completes the electrical path to thereby detonate the charge. Mine rollers are devices that are used to trigger PP-IEDs from a standoff distance. Mine rollers are pushed in front of combat vehicles and generate large downward forces to initiate detonation of a PP-IED on the receiving end of such downward forces. Current mine roller systems have solid, heavy frames that cannot be adjusted to accommodate various combat vehicle platforms or to meet transportation/storage requirements.

SUMMARY OF THE INVENTION

Accordingly, it is an object of the present invention to provide a mine roller that can be adjusted in size to accommodate a variety of vehicle sizes.

Another object of the present invention is to provide a mine roller having modular components that can be assembled/disassembled to provide for adjustment in size as well as to facilitate transportation or storage requirements.

Other objects and advantages of the present invention will become more obvious hereinafter in the specification and drawings.

In accordance with the present invention, a mine roller includes a bracket having a first end and a second end. The first end is adapted to be coupled to a vehicle. A rigid table has a center section and modular sections. The center section is coupled to the second end of the bracket for rotation about the second end in a first plane. The modular sections are coupled to the center section for rotation therewith. A first roller bank is coupled to a first of the modular sections for rotation relative thereto in a second plane that is perpendicular to the first plane. A second roller bank is coupled to a second of the modular sections for rotation relative thereto in the second plane.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
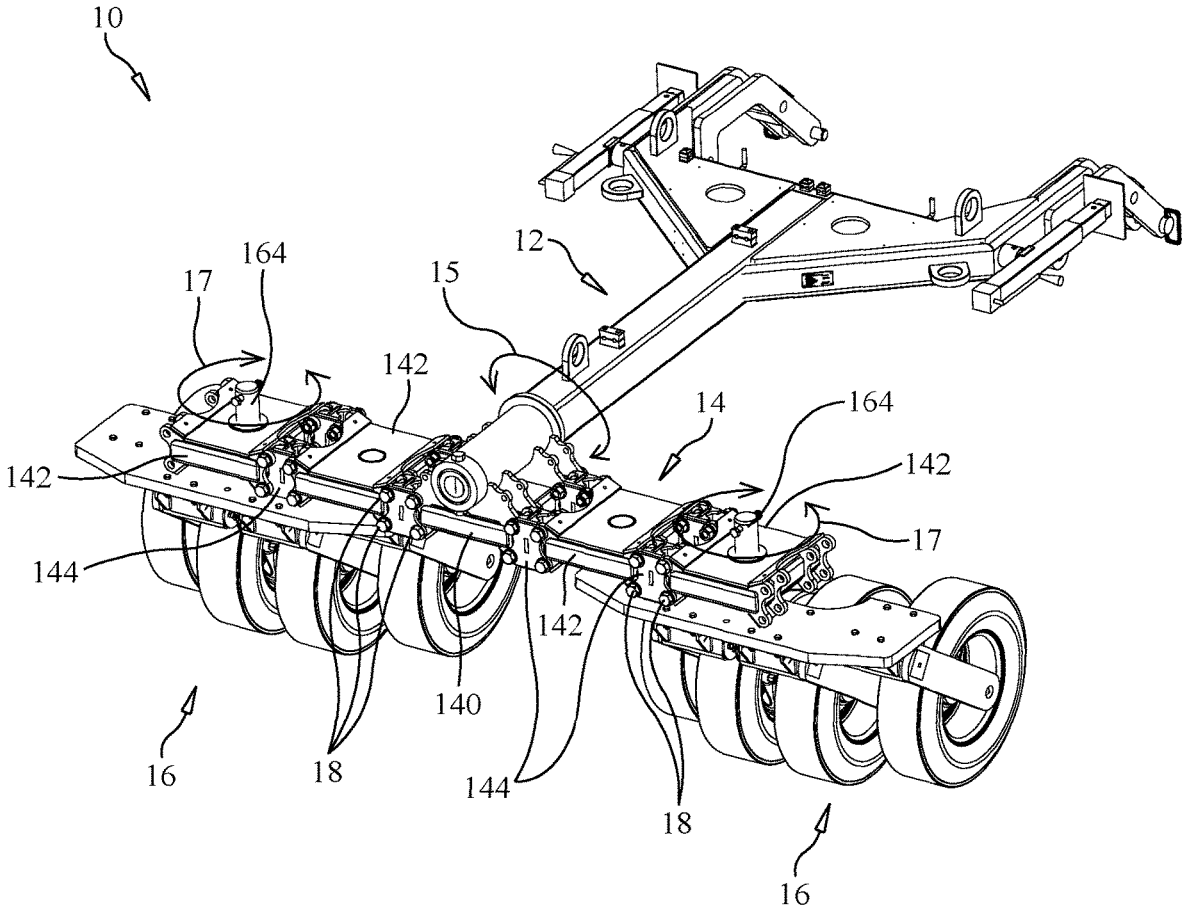
FIG. 1 is a perspective view of a modular and scalable mine roller in accordance with an embodiment of the present invention.
Figure 2:
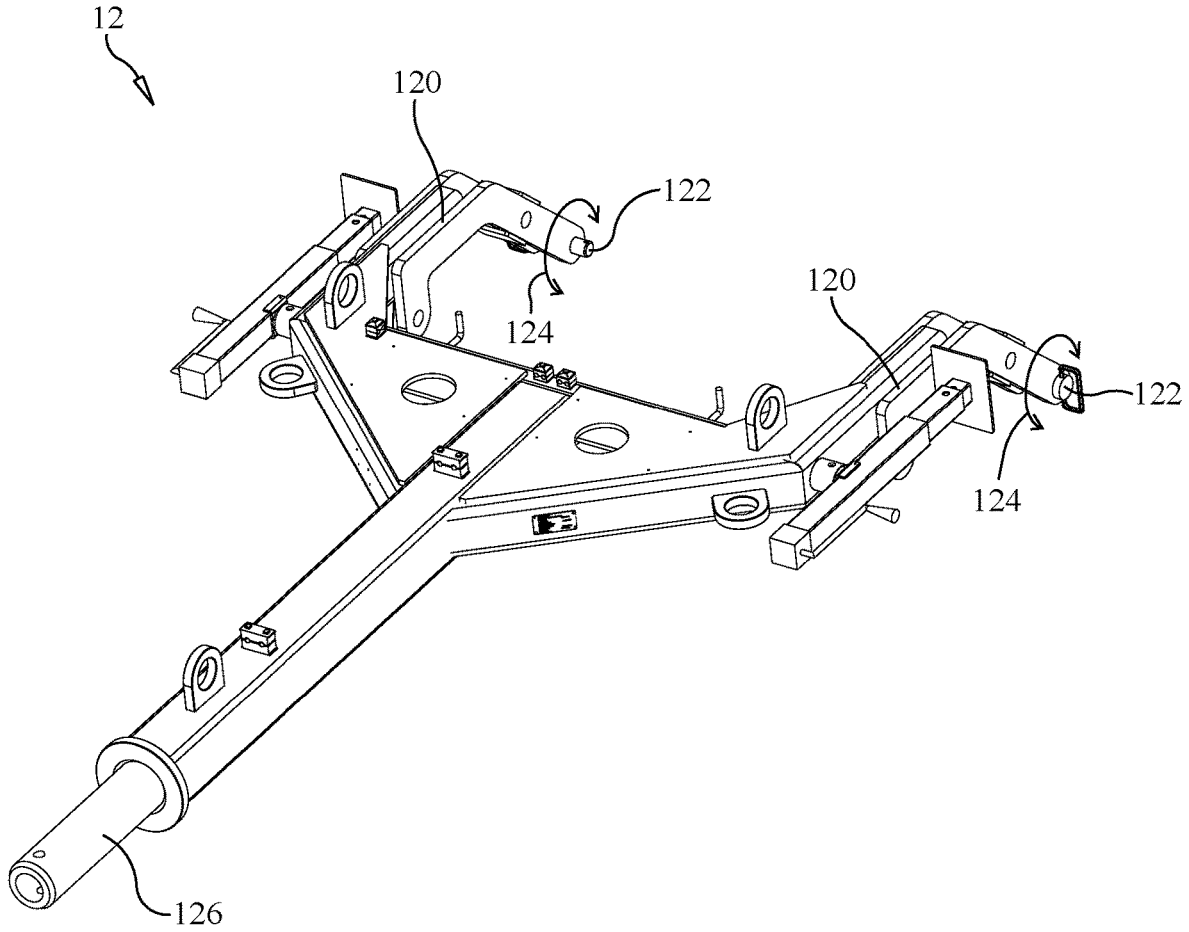
FIG. 2 is an isolated view of the bracket illustrated in FIG. 1.
Figure 3:
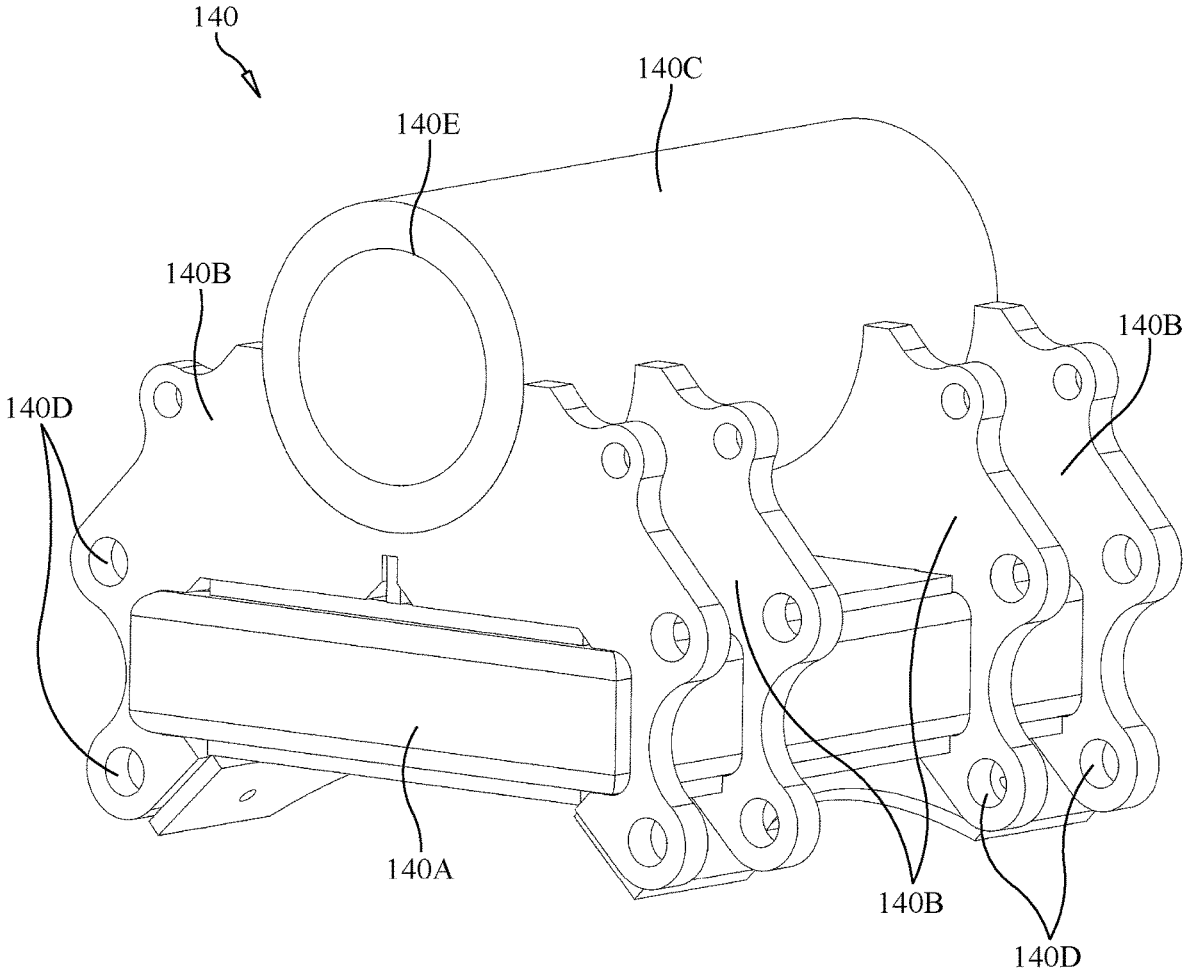
FIG. 3 is an isolated view of the table's center section illustrated in FIG. 1.

Referring now to the drawings, simultaneous reference will be made to FIGS. 1-6 where a modular and scalable mine roller in accordance with an embodiment of the present invention is shown fully assembled in FIG. 1 and is referenced generally by numeral 10. Mine roller 10 is configured to be coupled to the front portion of a vehicle (not shown), the choice of which is not a limitation of the present invention. FIGS. 2-6 present isolated views of the components or assemblies used to construct the illustrated mine roller 10.

Mine roller 10 includes a bracket 12 attachable on one end thereof to a vehicle, a rigid table 14, and two multi-wheel roller assemblies or banks 16. Bracket 12 (FIG. 2) is a rigid structure that includes two arms 120 at one end thereof whose outboard ends 122 are configured to be coupled to a vehicle such that bracket 12 can pivot about ends 122 as indicated by rotational arrows 124. The other end of bracket 12 terminates in a cylindrical mounting rod 126 used to couple bracket 12 to table 14 as will be explained further below.

Figure 4:
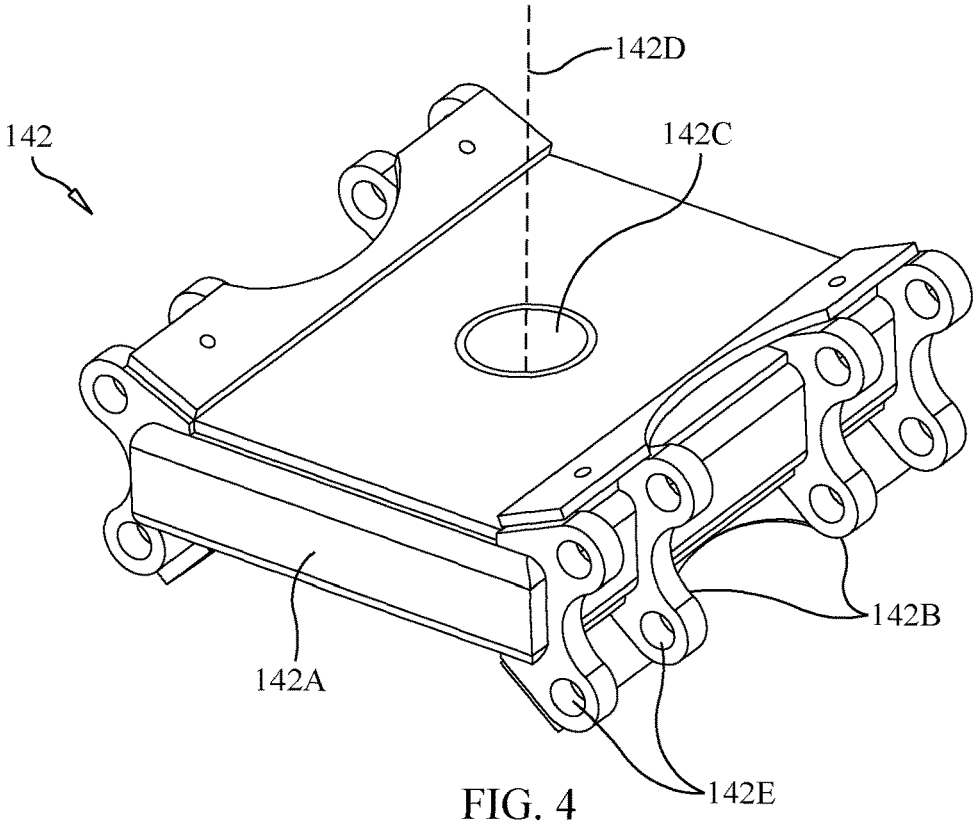
FIG. 4 is an isolated view of one of the table's side sections illustrated in FIG. 1.
Figure 5:
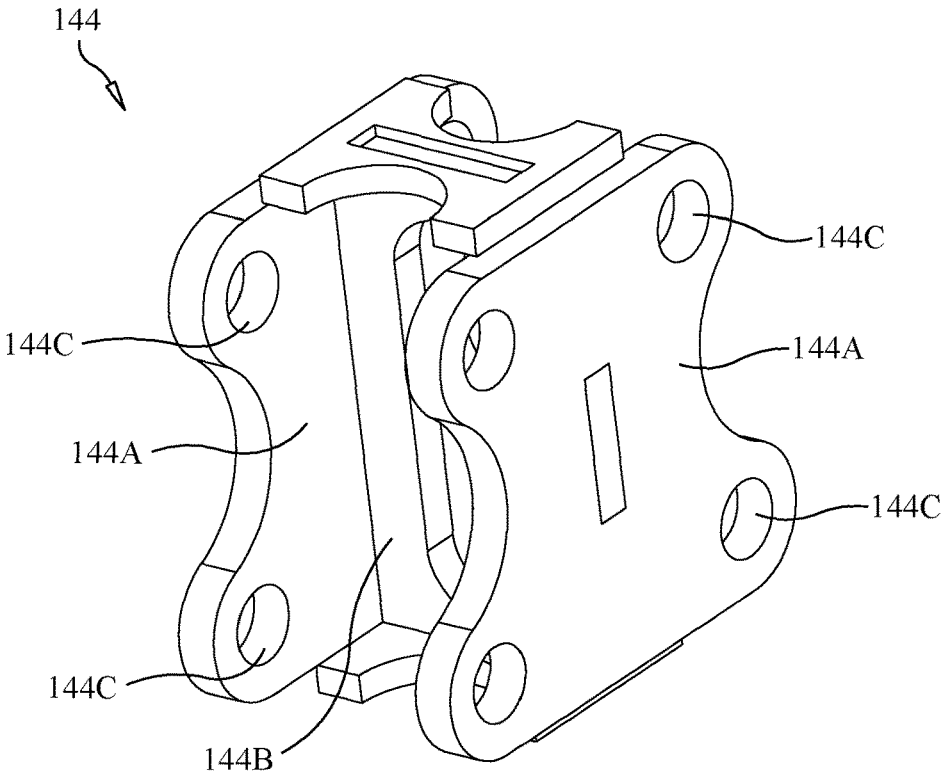
FIG. 5 is an isolated view of one of the section-coupling brackets illustrated in FIG. 1.
Figure 6:
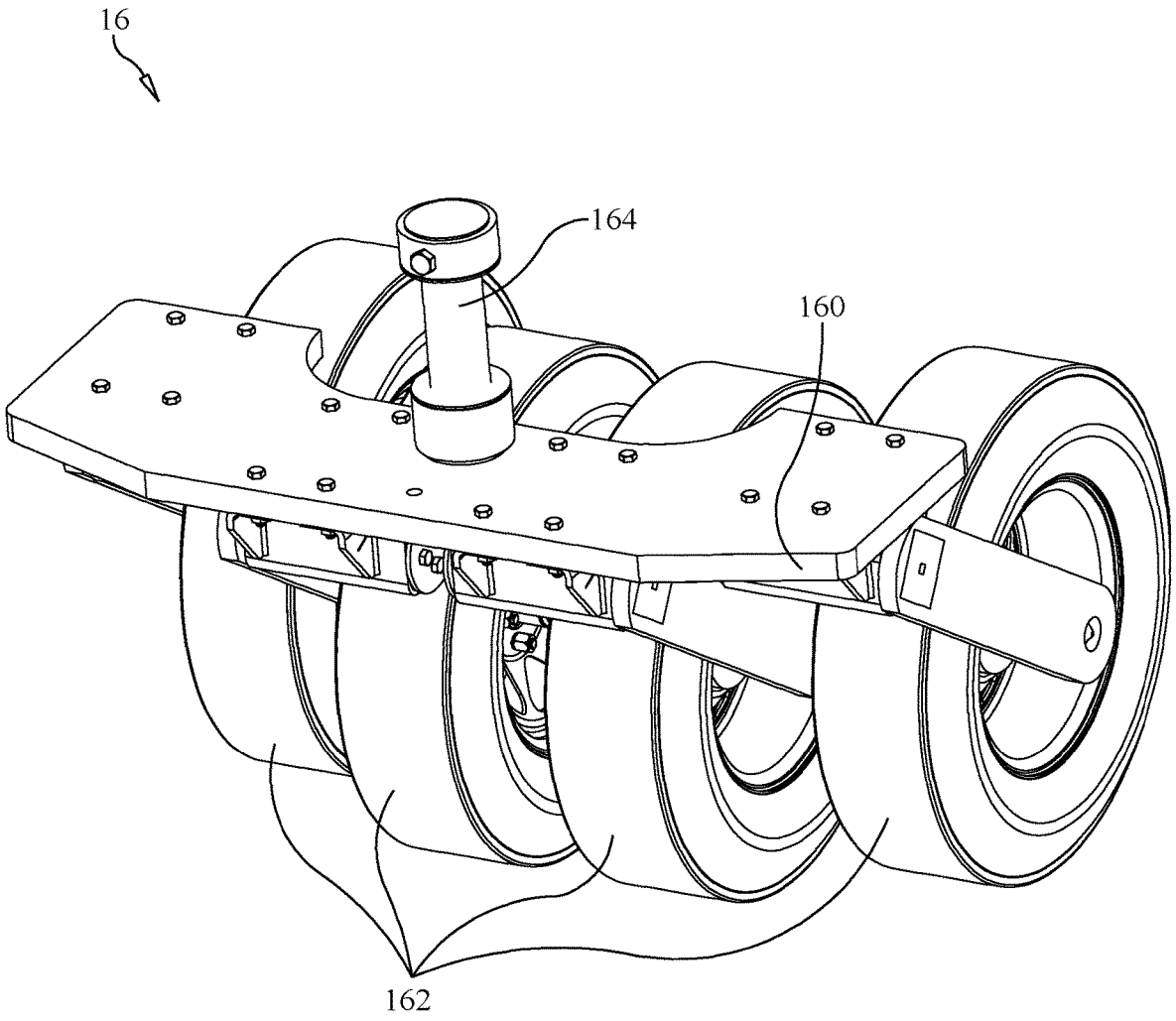
FIG. 6 is an isolated view of one of the roller banks illustrated in FIG. 1.

In the illustrated embodiment, table 14 includes a center section 140 (FIG. 3), a plurality of modular side sections 142 with one side section 142 being illustrated in FIG. 4, and a plurality of section-coupling brackets 144 with one bracket 144 being illustrated in FIG. 5. Table 14 is a rigid structure that can be configured to a desired length by selecting the appropriate number of side sections 142.

Center section 140 includes a base 140A, mounting plates 140B coupled to base 140A, and a mount 140C supported by and coupled to plates 140B. Each mounting plate 140B is provided with through holes 140D to facilitate coupling of side sections 142 as will be described later below. Mount 140C incorporates a cylindrical bushing 140E that is engaged by mounting rod 126 of bracket 12 such that center section 140 (as well as all of table 14) can rotate in a plane of rotation about rod 126 as indicated by rotation arrow 15 in FIG. 1. Rod 126 can be retained within mount 140C in any of a variety of ways well-known in the art (e.g., by use of a cotter pin or other transverse pin, end cap, etc.) without departing from the scope of the present invention.

Rigidly coupled to opposing sides of center section 140 are side sections 142. Typically, a mine roller configured in accordance with the present invention will utilize an even number of side sections 142 with one-half of them disposed on one side of center section 140 and the remaining half disposed on the opposing side of center section 140. For example, in the illustrated embodiment, a total of four side sections 142 are used in mine roller 10 with two side sections 142 disposed on each side of center section 140.

Each side section 142 (FIG. 4) includes a base 142A, mounting plates 142B coupled to base 142A, and a cylindrical bushing 142C passing completely through base 142A. The longitudinal axis of cylindrical bushing 142C is indicated by a dashed line referenced by numeral 142D. Each mounting plate 142B is provided with through holes 142E to facilitate coupling of side section 142 to center section 140 and/or one or more adjacent side sections depending on the configuration of table 14.

In the illustrated embodiment, section-coupling brackets 144 (FIG. 5) are used to facilitate the coupling of side sections 142 to center section 140 or to one another. Each bracket 144 includes opposing plates 144A spaced-apart from one another by an I-shaped support beam 144B. Each plate 144A has through holes 144C that are to be aligned with the holes 140D and/or 142E in mounting plates 140B and/or 142B, respectively, to facilitate rigid coupling using bolts 18 illustrated in FIG. 1. It is to be understood that coupling brackets 144 are not required to construct table 14. However, the use of brackets 144 generally allows machine tolerances to be relaxed with respect to mounting plate through hole alignment.

Each roller bank 16 (FIG. 6) includes a wheel suspension structure 160, wheels 162 coupled to suspension structure 160, and a cylindrical post 164 coupled to and extending up from suspension structure 160. In general, wheels 162 define the point of engagement with a ground surface (not shown) when mine roller 10 is coupled to a vehicle. A variety of constructions can be used for suspension structure 160 and wheels 162 without departing from the scope of the present invention. Cylindrical post 164 is sized and positioned for rotational engagement with one of bushings 142C as illustrated in FIG. 1. In this way, each roller bank is free to rotate in 360° about longitudinal axis 142D and in a plane that is perpendicular to the plane of rotation 15 and parallel to the plane of table 14 as indicated by rotational arrows 17 in FIG. 1. Each cylindrical post 164 can be retained within its bushing 142C in a variety of ways known in the art without departing from the scope of the present invention.

The advantages of the present invention are numerous. The modular and scalable table is readily adapted in width to accommodate a variety of roller banks. The mine roller is readily broken down for each of storage and transportation, and is readily assembled just prior to use. The table supports multi-dimensional movements that allow the mine roller to adapt to uneven surfaces while remaining in contact therewith to assure full ground engagement during a mine rolling application.

Although the invention has been described relative to specific embodiments thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. A mine roller, comprising:

a bracket having a first end and a second end, said first end adapted to be coupled to a vehicle;

a rigid table having a center section and at least four identical modular sections, said center section coupled to said second end of said bracket for rotation about said second end in a first plane, said modular sections coupled to said center section for rotation therewith;

each of said modular sections having a cylindrical bushing passing therethrough;

a first roller bank coupled to a first of said modular sections at said cylindrical bushing associated therewith for rotation relative thereto in a second plane that is perpendicular to said first plane; and a second roller bank coupled to a second of said modular sections at said cylindrical bushing associated therewith for rotation relative thereto in said second plane.

2. A mine roller as in claim 1, wherein said second end of said bracket is cylindrical, and wherein said center section includes a cylindrical bushing.

3. A mine roller as in claim 1, wherein each of said first roller bank and said second roller bank includes at least one wheel adapted to engage a ground surface when said bracket is coupled to a vehicle.

4. A mine roller as in claim 1, wherein said modular sections comprise an even number thereof, and wherein a first half of said modular sections are disposed on one side of said center section and a second half of said modular sections are disposed on an opposing side of said center section.

5. A mine roller as in claim 1, further comprising:

a plurality of section-coupling brackets, each of said section-coupling brackets disposed in a position between one of (i) said center section and one of said modular sections, and (ii) two of said modular sections; and a plurality of bolts for fixing each of said section-coupling brackets in said position associated therewith.

6. A mine roller, comprising:

a bracket having a first end and a second end, said first end adapted to be coupled to a vehicle;

a rigid table having a center section and at least four identical modular sections, said center section coupled to said second end of said bracket for rotation about said second end in a first plane, each of said modular sections rigidly coupled to at least one of said center section and an adjacent one of said modular sections, wherein said modular sections rotate in correspondence with said center section in said first plane;

each of said modular sections having a cylindrical bushing passing therethrough;

a first roller bank coupled to a first of said modular sections at said cylindrical bushing associated therewith for rotation relative thereto in a second plane that is perpendicular to said first plane; and a second roller bank coupled to a second of said modular sections at said cylindrical bushing associated therewith for rotation relative thereto in said second plane.

7. A mine roller as in claim 6, wherein said second end of said bracket is cylindrical, and wherein said center section includes a cylindrical bushing.

8. A mine roller as in claim 6, wherein each of said first roller bank and said second roller bank includes at least one wheel adapted to engage a ground surface when said bracket is coupled to a vehicle.

9. A mine roller as in claim 6, wherein said modular sections comprise an even number thereof, and wherein a first half of said modular sections are disposed on one side of said center section and a second half of said modular sections are disposed on an opposing side of said center section.

10. A mine roller as in claim 6, further comprising:

a plurality of section-coupling brackets, each of said section-coupling brackets disposed in a position between one of (i) said center section and one of said modular sections, and (ii) two of said modular sections; and a plurality of bolts for fixing each of said section-coupling brackets in said position associated therewith.

11. A mine roller, comprising:

a bracket having a first end and a second end, said first end adapted to be coupled to a vehicle;

a rigid table having a center section, at least four modular sections, a plurality of section-coupling brackets, and a plurality of bolts, said center section coupled to said second end of said bracket for rotation about said second end in a first plane, each of said section-coupling brackets disposed in a position between one of (i) said center section and one of said modular sections, and (ii) two of said modular sections, a portion of said bolts rigidly coupling each of said section-coupling brackets in said position associated therewith, wherein said modular sections rotate in correspondence with said center section in said first plane;

each of said modular sections being identically configured and including a cylindrical bushing having a longitudinal axis extending parallel to said first plane;

a first roller bank rotatably coupled to a first of said modular sections at said cylindrical bushing associated therewith, wherein said first roller bank is rotatable relative to said first of said modular sections in a second plane that is perpendicular to said first plane; and a second roller bank rotatably coupled to a second of said modular sections at said cylindrical bushing associated therewith, wherein said second roller bank is rotatable relative to said second of said modular sections in said second plane.

12. A mine roller as in claim 11, wherein said first roller bank includes a cylindrical post for rotational engagement with said cylindrical bushing associated with said first of said modular sections.

13. A mine roller as in claim 11, wherein said second roller bank includes a cylindrical post for rotational engagement with said cylindrical bushing associated with said second of said modular sections.

14. A mine roller as in claim 11, wherein each of said first roller bank and said second roller bank includes at least one wheel adapted to engage a ground surface when said bracket is coupled to a vehicle.

15. A mine roller as in claim 11, wherein said modular sections comprise an even number thereof, and wherein a first half of said modular sections are disposed on one side of said center section and a second half of said modular sections are disposed on an opposing side of said center section.

* * * * *